US011845576B2

(12) United States Patent
Paganini et al.

(10) Patent No.: US 11,845,576 B2
(45) Date of Patent: Dec. 19, 2023

(54) MACHINE AND METHOD FOR PACKAGING ROLLS AND THE LIKE

(71) Applicant: Korber Tissue S.p.A., Lucca (IT)

(72) Inventors: Livio Paganini, Lucca (IT); Daniele Scannavini, Lucca (IT); Andrea Degli Esposti, Lucca (IT)

(73) Assignee: Korber Tissue S.p.A., Lucca (IT)

( * ) Notice: Subject to any disclaimer, the term of this patent is extended or adjusted under 35 U.S.C. 154(b) by 2 days.

(21) Appl. No.: 17/627,921

(22) PCT Filed: Jul. 17, 2020

(86) PCT No.: PCT/EP2020/070256

§ 371 (c)(1),
(2) Date: Jan. 18, 2022

(87) PCT Pub. No.: WO2021/009340

PCT Pub. Date: Jan. 21, 2021

(65) Prior Publication Data

US 2022/0258890 A1 Aug. 18, 2022

(30) Foreign Application Priority Data

Jul. 18, 2019 (IT) ..... 102019000012279

(51) Int. Cl.
*B65B 11/22* (2006.01)
*B65B 25/14* (2006.01)

(52) U.S. Cl.
CPC ..... *B65B 11/22* (2013.01); *B65B 25/146* (2013.01)

(58) Field of Classification Search
CPC ..... B65B 11/22; B65B 25/146
See application file for complete search history.

(56) References Cited

U.S. PATENT DOCUMENTS

| | | | | |
|---|---|---|---|---|
| 1,554,369 | A | 9/1925 | Remington | |
| 4,651,500 | A | 3/1987 | Chaffey | |
| 5,287,679 | A * | 2/1994 | Dall'Omo | B65B 51/16 53/375.9 |
| 6,688,082 | B1 * | 2/2004 | Loperfido | B65B 59/003 53/64 |
| 9,926,089 | B2 * | 3/2018 | Ageling | B65B 51/02 |
| 2002/0059778 | A1 * | 5/2002 | Gamberini | B65B 11/20 53/128.1 |
| 2002/0059779 | A1 * | 5/2002 | Gamberini | B65B 25/146 53/228 |
| 2014/0260087 | A1 | 9/2014 | Antoniazzi et al. | |
| 2015/0251785 | A1 | 9/2015 | Canini et al. | |
| 2017/0320605 | A1 * | 11/2017 | Rasi | B65B 41/02 |

FOREIGN PATENT DOCUMENTS

| | | | |
|---|---|---|---|
| CN | 106542366 | A | 3/2017 |
| EP | 1518787 | B1 | 5/2012 |

* cited by examiner

*Primary Examiner* — Andrew M Tecco
*Assistant Examiner* — Nicholas E Igbokwe
(74) *Attorney, Agent, or Firm* — Breiner & Breiner, L.L.C.

(57) ABSTRACT

The machine includes a device for spreading a wrapping sheet and an elevator, adapted to move a roll to be wrapped with respect to the wrapping sheet, so as to wrap the wrapping sheet around the roll as a result of the movement between the wrapping sheet and the roll. The machine further includes members adapted to reduce the formation of creases in the wrapping sheet during the movement of the roll with respect to the wrapping sheet.

20 Claims, 7 Drawing Sheets

MACHINE AND METHOD FOR PACKAGING ROLLS AND THE LIKE

TECHNICAL FIELD

There are disclosed methods and machines for packaging products in wrapping sheets, for example in sheets of plastic film or paper. Embodiments disclosed herein relate in particular to packaging of single rolls of web material, such as tissue paper.

BACKGROUND

In many industrial fields, it is common to package products in wrapping sheets, for example, but not exclusively, sheets of plastic, i.e., polymeric, film.

Typically, packages of products in wrapping sheets are used in the field of tissue paper products. For example, rolls of toilet paper, rolls of kitchen towels and the like are packaged in wrapping sheets. In some cases, the rolls are assembled in ordered groups with one or more layers of rolls, superimposed vertically, each of which contains two or more rows of rolls.

In other cases, the rolls are packaged individually or in groups, each of which contains a single row of two or more rolls, arranged coaxially. In both cases the final package has a substantially cylindrical shape.

The wrapping sheets are usually made of plastic film, but can also be made of other materials, such as paper.

Machines adapted to package single rolls are disclosed in US2002/0059778, CN106542366, U.S. Pat. No. 4,651,500, EP1.518.787, US2015/0251785, US2014/0260087. In particular the last two publications mentioned above disclose a machine adapted to form packages of single rolls or of ordered groups of rolls with a simple adaptation of the machine.

With specific reference to the production of packages of single rolls, or of rolls aligned coaxially, in some known machines, each roll is arranged on an elevator that moves according to a trajectory approximately orthogonal to a geometric plane, at which a wrapping sheet is preliminarily spread. The movement between the wrapping sheet and the roll causes the wrapping sheet to wrap around a portion of the lateral surface of the roll. Once the first step of wrapping has been performed, the wrapping sheet is wrapped completely around the roll, so that the cylindrical surface thereof is completely covered by the wrapping sheet, while the flat surfaces of the roll remain free. Portions of wrapping sheet protruding from the flat surfaces of the roll are then folded against the aforesaid lateral surfaces to complete closing of the package.

For lines that produce articles or products to be packaged in the aforesaid manner, there is constant research for technical solutions adapted to increase the productivity of the production lines in which the packaging machines are included. This leads to the need to produce increasingly fast packaging machines, which also ensure the quality of the package produced.

SUMMARY

According to one aspect, a machine for packaging rolls or the like is provided, comprising a device for spreading a wrapping sheet, for example arranging it according to an approximately horizontal plane. The machine further comprises an elevator, adapted to move a roll to be wrapped with respect to the wrapping sheet, so as to wrap the wrapping sheet around the roll as a result of the movement between the wrapping sheet and the roll. A first lateral wall and a second lateral wall, approximately parallel to each other, are associated with the elevator. The elevator is vertically movable between the first lateral wall and the second lateral wall. Advantageously, the machine comprises members adapted to reduce the formation of creases in the wrapping sheet during the movement of the roll with respect to the wrapping sheet.

The members adapted to reduce the formation of creases are integral with the elevator and move therewith.

The members to reduce the formation of creases are configured to co-act with at least one of the lateral walls between which the elevator moves. In some embodiments, the members adapted to reduce the formation of creases comprise, on at least one side of the elevator, a contact and rubbing member, oriented from the elevator toward one of said first lateral wall and second lateral wall, arranged so that, when the elevator lifts the roll toward the wrapping sheet, said wrapping sheet is interposed between the contact and rubbing member and said lateral wall, the contact and rubbing member generating a contact force on the wrapping sheet and against the lateral wall at least in a lowering step the elevator.

With this arrangement, when the elevator moves between the two lateral walls, the contact and rubbing member rubs on the wrapping sheet, or more precisely on a flap thereof, eliminating or at least partly flattening the creases that may have formed during the step in which the wrapping sheet is partially wrapped around the roll. Typically, the flattening effect occurs in the lowering step of the elevator when the roll is half wrapped by the wrapping sheet and the lateral flaps thereof hang downward waiting to be folded one on top of the other to complete wrapping of the roll.

The contact and rubbing member can comprise a brush, a rubber profile or other suitable material.

Although in some embodiments a single contact and rubbing member is provided, in other embodiments two contact and rubbing members can be provided, one on each side of the elevator, to flatten, stretch or smooth two opposite flaps of the wrapping sheet.

It would also be possible for each contact and rubbing member to comprise several members arranged one on top of the other in the direction of movement of the elevator, for example several brushes arranged vertically one on top of the other, to obtain a greater flattening and creases elimination effect.

In some embodiments, the members adapted to reduce the formation of creases can comprise a first plate integral with the elevator and approximately parallel to one of said first lateral wall and second lateral wall. The first plate extends downward away from a seat for receiving the roll, integral with the elevator and defines, with the respective lateral wall with which it is parallel, a first gap configured to receive therein a first flap of the wrapping sheet during the lifting movement of the elevator.

As will be apparent from the following detailed description of the accompanying figures, during the movement of the elevator, the flap of wrapping sheet that is received and guided in the gap suffers less from the aerodynamic effect caused by the rapid movement in the air. This reduces the formation of creases in the flap of the wrapping sheet.

In practical embodiments, the machine comprises a conveyor device having a plurality of housing compartments adapted to receive rolls and related wrapping sheets from the elevator. The conveyor device is provided with a roll advancing movement from a position where rolls are received from the elevator, toward folding members adapted to fold the wrapping sheet on end surfaces of the roll, and members for closing of the package. The conveyor device can be configured so that the roll that is inserted into the conveyor device is retained therein while the elevator is lowered, allowing the operation of lower folding members, which fold and mutually overlap two edges of the wrapping sheet, to complete lateral wrapping of the roll.

According to another aspect, a method for wrapping a roll in a wrapping sheet is described, comprising the steps of: arranging a roll on an elevator positioned between a first lateral wall and a second lateral wall and movable therebetween; arranging a wrapping sheet on an approximately horizontal plane, which intersects a trajectory of movement of the elevator between the first lateral wall and the second lateral wall; lifting the roll by means of the elevator against the wrapping sheet so as to partially wrap the roll with the wrapping sheet, generating two flaps of the wrapping sheet extending below the elevator; wrapping the two flaps of the wrapping sheet around the roll. During the movement of the elevator with respect to the wrapping sheet, a flattening action is exerted on at least one of said flaps. This can be obtained with a brush or other contact and rubbing means. In some embodiments, the flattening effect is obtained by guiding the wrapping sheet through a gap between a lateral wall and a plate integral with the elevator that lifts the roll. In the gap the wrapping sheet, or more precisely a flap thereof, remains guided and spread, with a flattening effect provided by the presence of the guide gap.

Further features and embodiments of the machine and of the method of the present description will be illustrated below and defined in the appended claims, which form an integral part of the present description.

BRIEF DESCRIPTION OF THE DRAWINGS

The invention will be better understood following the description and the accompanying drawings, which illustrate a non-limiting example of embodiment of the invention. More in particular, in the drawing.

DETAILED DESCRIPTION

Before describing in detail an exemplary embodiment of the packaging machine and of the related packaging method, with initial reference to the sequence of FIGS. 3A-3G the cycle of wrapping a roll R in a wrapping sheet F will be described.

A package C (FIG. 3G) is obtained starting from a wrapping sheet F (FIG. 3A) and a roll R. In place of a single roll R, a row of axially aligned rolls R can be provided.

Figure 3:
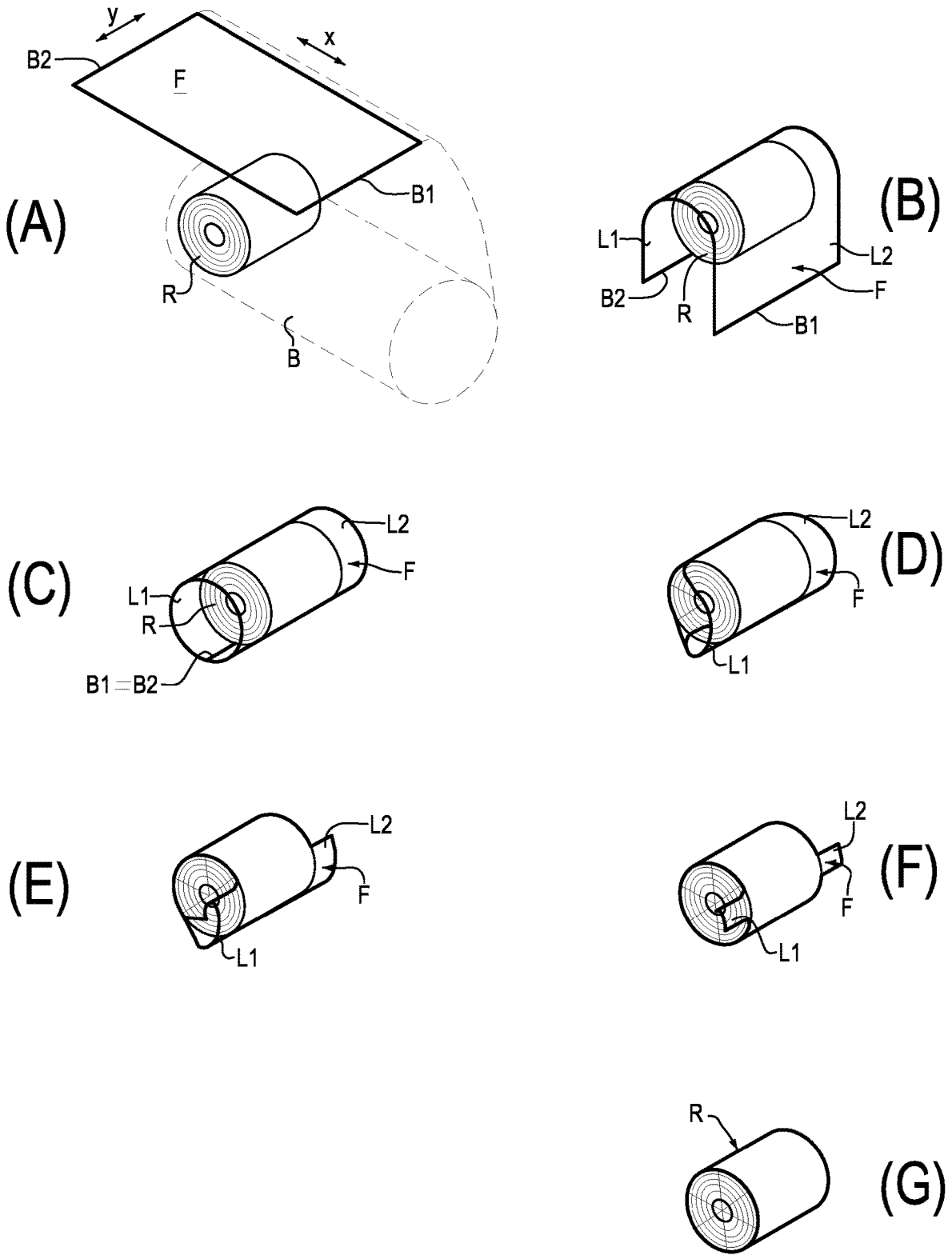
FIGS. 3A-3G show a folding sequence of a wrapping sheet around a roll to be wrapped.

In general, the wrapping sheet F is arranged along an approximately horizontal plane, as shown in FIG. 3A. This means that the wrapping sheet F is held spread flat so as to take an approximately planar form, which however is only approximate as, for example, also as a result of its weight, the wrapping sheet F may be arranged in a manner that is not perfectly flat.

The wrapping sheet F can be a portion of a plastic, i.e., polymer, film, or a sheet of paper, unwound from a reel B, shown indicatively with a dashed line in FIG. 3A. The way in which the wrapping sheet F is unwound and separated from the reel B is known and does not require further description.

The roll R to be packaged is placed in front of the wrapping sheet F. In particular, the roll R to be packaged can be placed under the wrapping sheet F. The roll R to be packaged can be placed on an elevator, not shown in the sequence of FIGS. 3A-3G, but described below with reference to FIGS. 1 and 2A-2E.

The wrapping sheet F has two edges B1, B2 that will be overlapped and glued or welded to each other, to wrap the roll R laterally, forming a tubular winding around this latter.

To package the roll R, in a first step of the packaging cycle the wrapping sheet F and the roll R are moved one with respect to the other according to a direction substantially orthogonal to the plane on which the wrapping sheet F is arranged in FIG. 3A. As can be seen in FIG. 3B, this relative movement causes the wrapping sheet F to wrap around the roll R by approximately 180°. The dimension of the wrapping sheet F in the direction X (FIG. 3A) is such that the two edges B1, B2 of the wrapping sheet F are located under the roll R and spaced therefrom, so as to be able to complete wrapping of the roll R through 360°, as described below. In practice, two portions of wrapping sheet, indicated as free lateral flaps La and Lb, i.e., not in contact with the lateral cylindrical surface of the roll R, extend from the edges B1 and B2. In practice, the flap La extends from the point of tangency of the wrapping sheet F with the roll R up to the edge B1 and the flap Lb extends from the point of tangency of the wrapping sheet F with the roll R up to the edge B2.

Preferably, the wrapping sheet F is not centered with respect to the roll R in the direction X, i.e., the flaps La and Lb do not have the same length, so that the sheet F protrudes with respect to the roll R to a greater extent on the side of the edge B1 than on the side of the edge B2, or vice versa.

In practice, the dimension in direction X of the wrapping sheet F (which preferably is rectangular in shape) is greater that the extension of the circumference of the circular section of the roll R, so that the roll R can be completely wrapped laterally causing the edges B1 and B2 to overlap slightly when the wrapping sheet F is wrapped around the lower area of the roll R, as visible in FIG. 3C. In this condition, the two edges B1, B2 are mutually overlapped and can be glued or welded, to form with the wrapping sheet F a sort of tube around the roll R.

In the direction Y the wrapping sheet F has a dimension larger than the axial dimension of the roll R. In this way, as can be seen in FIG. 3C, the wrapping sheet F protrudes with flaps L1 and L2 from two mutually opposite flat faces of the roll R. These two flat faces are for the moment free, while the lateral cylindrical surface of the roll R is wrapped by wrapping sheet F arranged in tubular form around the roll R. The edges B1 and B2 are mutually overlapped and can be glued or welded in this step.

With subsequent folding operations, illustrated in the sequence of FIGS. 3D, 3E, 3F, 3G, the two flaps L1 and L2 are folded against the two flat surfaces of the roll R, until obtaining the final package (FIG. 3G). The folded flaps L1, L2 can be stabilized by welding, or gluing, or by applying an adhesive sheet to the folded portions of the wrapping sheet F. In other configurations, not shown, in the case of a roll R of paper wound on a tubular core and preferably in the case of a paper rather than a plastic wrapping sheet, it is possible to twist the flaps L1, L2 around the two flat surfaces of the roll R and subsequently stabilize the winding by pushing the central portion of the twisted wrapping sheet inside the tubular winding core. An example of this wrapping method is disclosed in EP1518787.

It has been found in practice that in the steps illustrated in FIGS. 3A, 3B and 3C, the flaps La and Lb of the wrapping sheet F can tend to form creases, in particular at high movement speeds of the roll R, due both to the impact between roll and sheet, and to the aerodynamic effects on the wrapping sheet F. When creases form, the wrapping sheet F folded around the roll R and welded (or glued) has an irregular appearance and/or may not adhere correctly to the roll, giving rise to a package of poor quality. Packages with these defects must be discarded, or become products of lower quality, sold at lower prices.

The higher the production speed is, the more evident these defects become.

The embodiments described below of machines and methods according to the present invention reduce or eliminate these problems, allowing packages of high quality to be obtained even with very high production speeds.

Moreover, it is possible to obtain high quality packages even with thin and hence less expensive and less polluting wrapping sheets, which would tend to form too many creases in conventional machines.

To prevent or reduce the occurrence of defects in the finished package C, especially at high production speeds, the method described here provides for applying on the flaps La and Lb a stretching action during the relative movement between the roll and the wrapping sheet, or more generally during the movement between the wrapping sheet and the elevator that moves the roll R with respect to the wrapping sheet F in the steps pursuant to FIGS. 3A, 3B.

Figure 1:
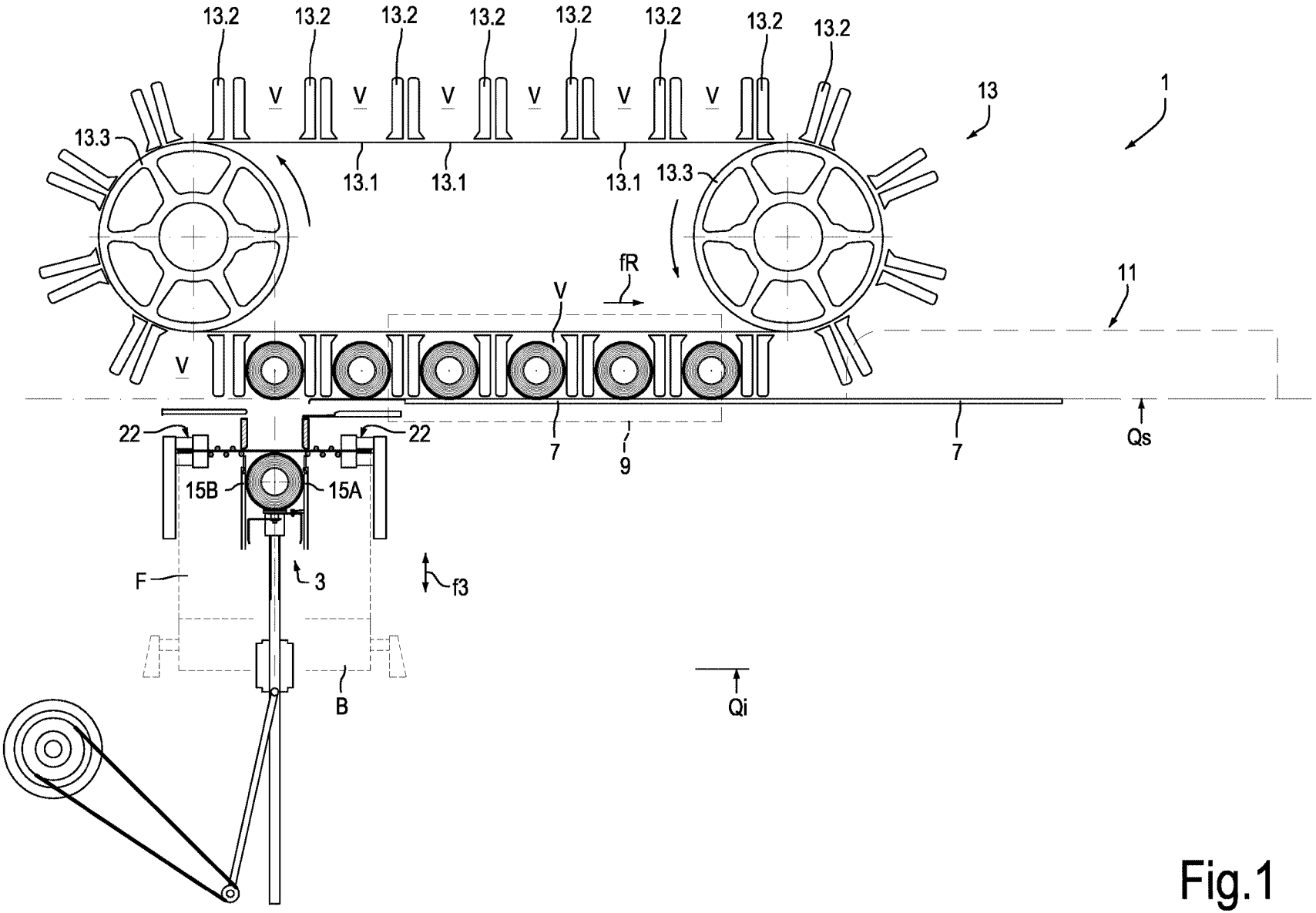
FIG. 1 shows a schematic side view of a machine according to the invention.

FIG. 1 illustrates a schematic side view of packaging machine 1 in which the invention can be implemented. The general structure of the machine 1 is known per se and more details on the various possible embodiments are described in the patent publications mentioned in the introduction of the present description. General features of the packaging machine 1, useful for understanding the invention, as well as details of embodiments of the innovative components, will be described below.

The packaging machine 1 comprises an elevator 3 provided with a movement according to a substantially vertical direction indicated with the double arrow f3. The elevator 3 has the function of lifting the rolls R from a lower position Qi, at which the products are fed from a feed assembly (not shown), to an upper position Qs, at which a sliding plane 7 formed by a stationary plate, for example made of metal sheet, is located, along which the rolls R advance to complete the packaging cycle and obtain the finished package C (FIG. 3G).

Once a roll R has reached the upper position Qs, it advances according to the arrow fR along the sliding plane 7 through a folding assembly 9 and a welding assembly 11. These folding and welding assemblies are only represented with a dashed line, as they are known per se and can be designed in any suitable manner.

The advance of the rolls R according to the arrow fR is obtained by means of a conveyor device 13, which comprises flexible members 13.1, to which teeth 13.2 are constrained. These latter define compartments V for receiving and advancing the groups G of products R. The flexible members 13.1 are guided around guide wheels 13.3, suitably motorized to move the flexible members 13.1, and hence the teeth 13.2, along a closed path. The active branch of the closed path is the lower branch, at which the groups G of products R are inserted into the compartments V and are advanced according to the arrow fR.

Each roll R is inserted into the elevator 3 between a pair of lateral walls 15A, 15B and an end wall, not shown. The lateral walls 15A, 15B are visible in particular also in FIGS. 2A-2E. The position and the distance between the two lateral walls 15A, 15B can be adjusted as a function of the dimension of the rolls R, in a manner known per se. The lateral walls 15A, 15B are substantially mutually parallel and define therebetween the space for movement of the elevator 3. The trajectory of the elevator 3 thus extends between the two lateral walls 15A, 15B and is substantially parallel thereto.

As visible in FIG. 1 and in greater detail in FIGS. 2A-2E, each lateral wall 15A, 15B has two portions, upper and lower, between which a respective slit 17A, 17B is provided. The two portions of each wall can also be completely separate from each other and connected, for example, to a common supporting structure. The wrapping sheet F is unwound from the reel B, shown schematically in FIG. 1, and passes through the slits 17A, 17B. In advantageous embodiments, the wrapping sheet F is conveyed by belts or other feed members 22, which engage the edges B1, B2 (FIG. 2A) of the wrapping sheet F and unwind it on a substantially horizontal geometric plane, passing through the two slits 17A, 17B. To support the wrapping sheet F in an approximately flat arrangement, supporting elements 23 can be provided, for example in the form of bars extending parallel to the edges B1, B2 of the wrapping sheet F spread flat and extending through the slits 17A, 17B. The feed members 22 and the supporting elements 23 can be (or form part of) a device for spreading the wrapping sheet F on a horizontal plane in order to start the packaging cycle.

When a roll R has been arranged on the elevator 3, this is lifted (arrow f3) to carry the roll R to the upper position Qs at which the sliding plane 7 is located, inserting it into one of the compartments V defined by the teeth 13.2 of the conveyor device 13. In the lifting movement the roll R is partially wrapped by the wrapping sheet F as illustrated in the sequence of FIGS. 3A, 3B described above. Once the roll R has been inserted into the respective compartment V of the conveyor device 13, it advances according to the arrow fR through the folding assembly 9 and the welding assembly 11. Passing between the lateral walls 15A, 15B beyond the slits 17A, 17B, the roll R engages the wrapping sheet F, causing it to be arranged around approximately half of its circumferential extension, taking the position of FIG. 3B.

Approximately at the level of the sliding plane 7 there are arranged a first lower movable folding member 33 and a second lower movable folding member 35, which move horizontally toward each other to fold the wrapping sheet F under the roll R and overlap the edges B1, B2, so that the flaps La, Lb (FIGS. 3A-3C) complete wrapping of the cylindrical surface of the roll R, while the elevator is lowered toward the lower height Qi.

Figure 2A:
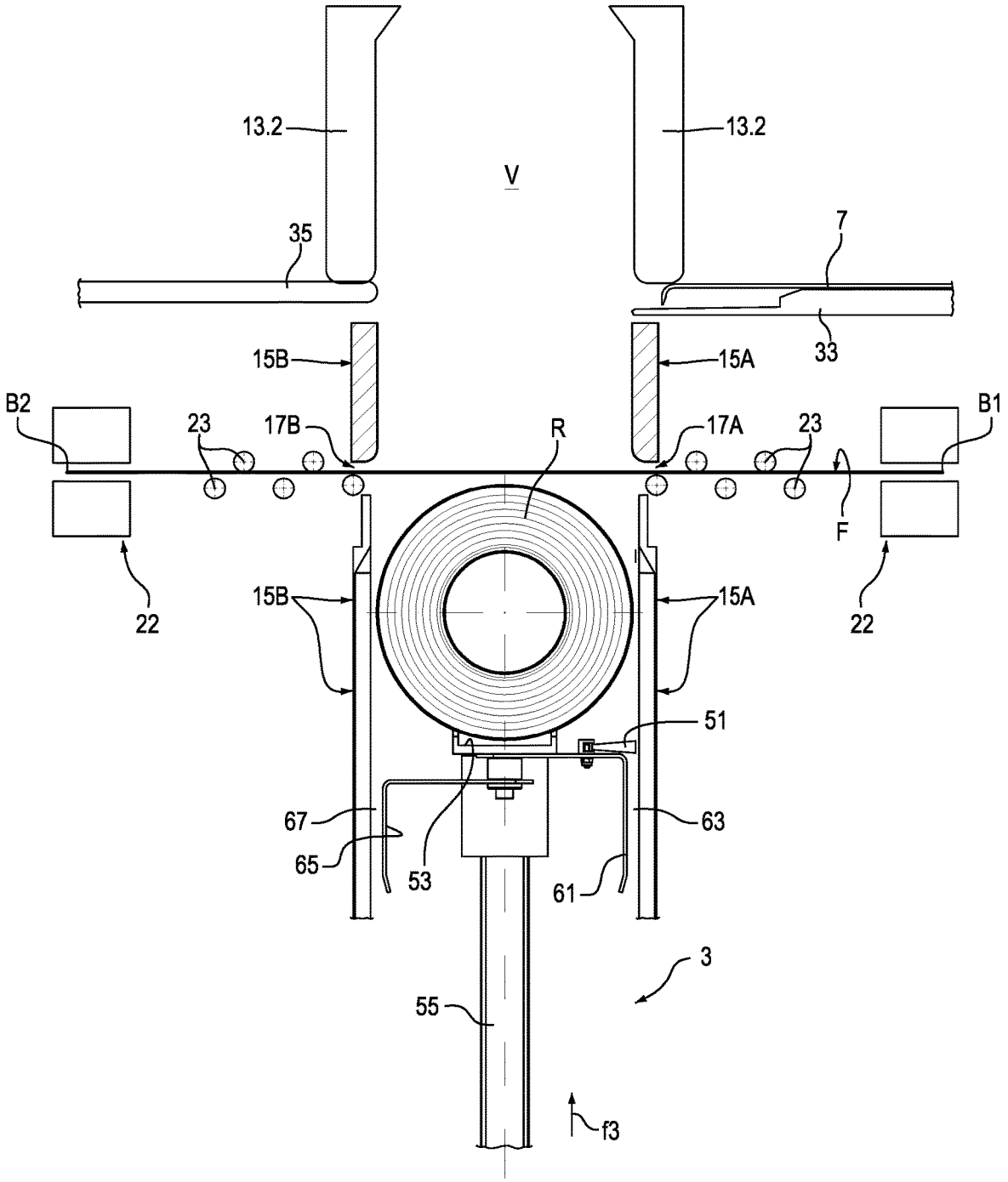
FIGS. 2A to 2E show an operating sequence of the machine of FIG. 1.
Figure 2B:
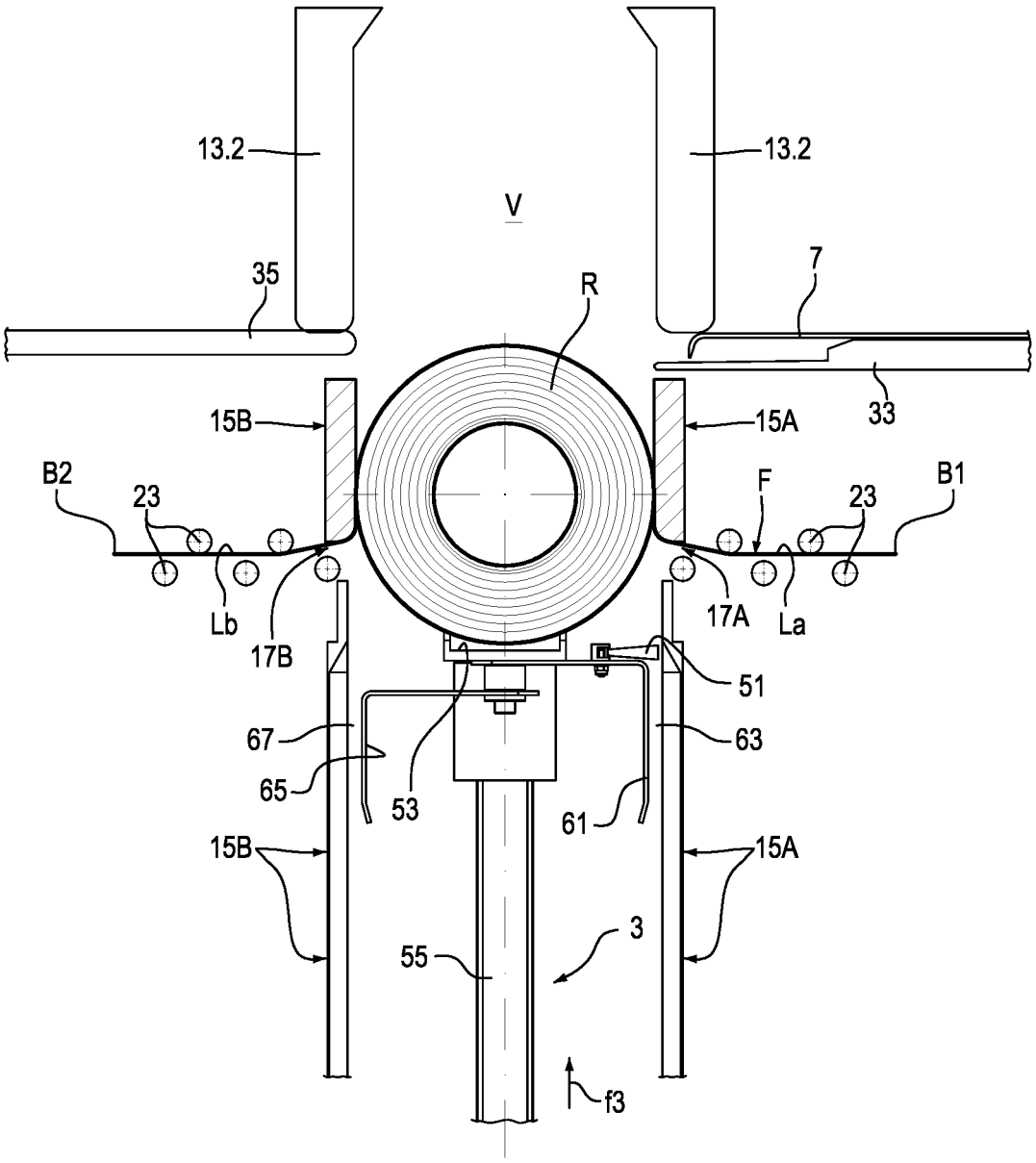

This sequence of steps is illustrated in greater detail in FIGS. 2A, 2B, 2C, 2D, 2E. More in particular, in FIG. 2A the roll R is located immediately below the plane on which the wrapping sheet F has been spread. In FIG. 2B the roll R has been lifted and is partially wrapped by the wrapping sheet F. As a result of traction produced by the roll R that is being lifted and around which the sheet F is being wrapped, the wrapping sheet F is detached from the members 22 that retain the edges B1, B2 thereof. The flaps La and Lb of the wrapping sheet are therefore substantially free in this step, except for the guiding effect obtainable by the bars 23.

Figure 2C:
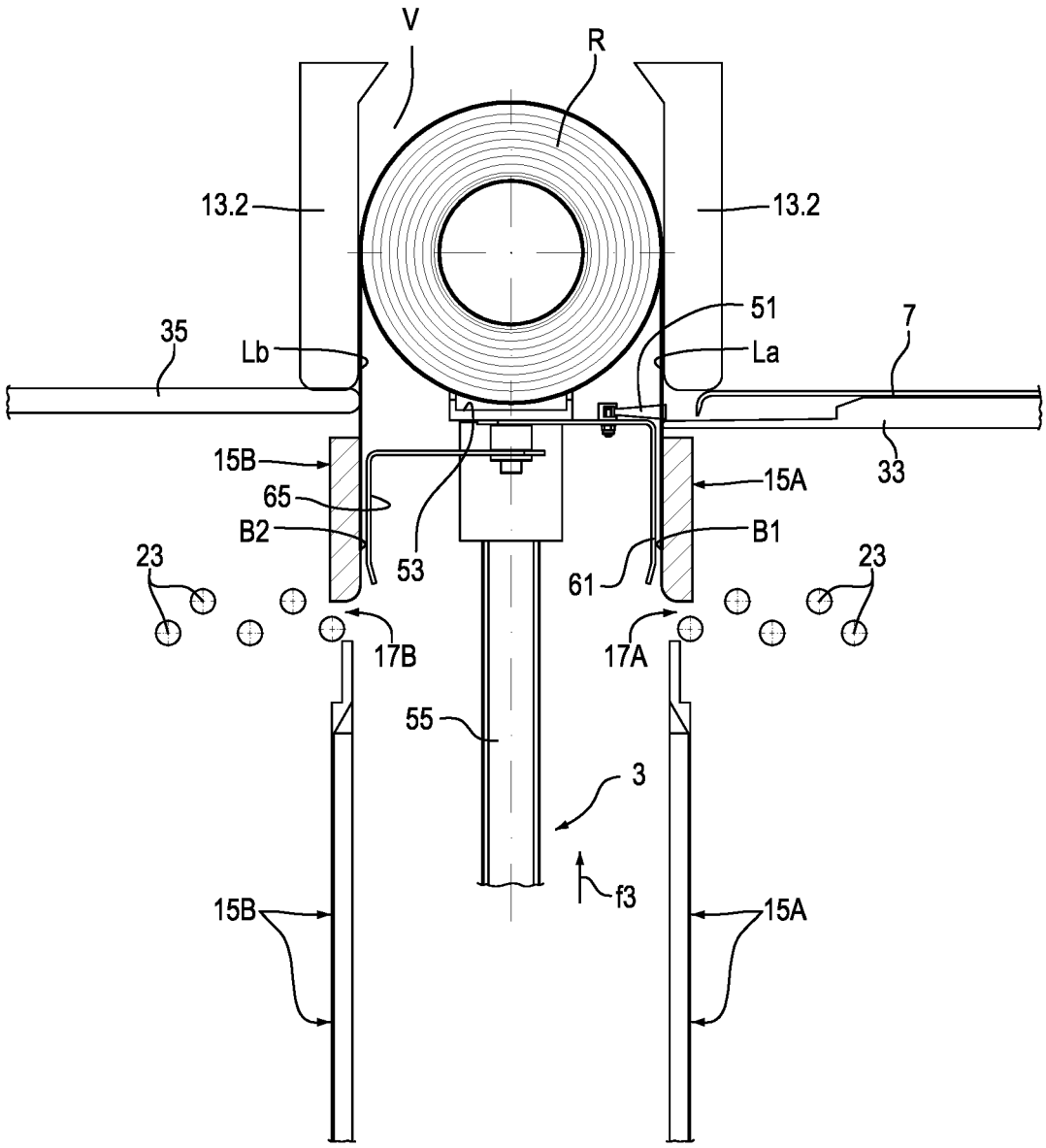
Figure 2D:
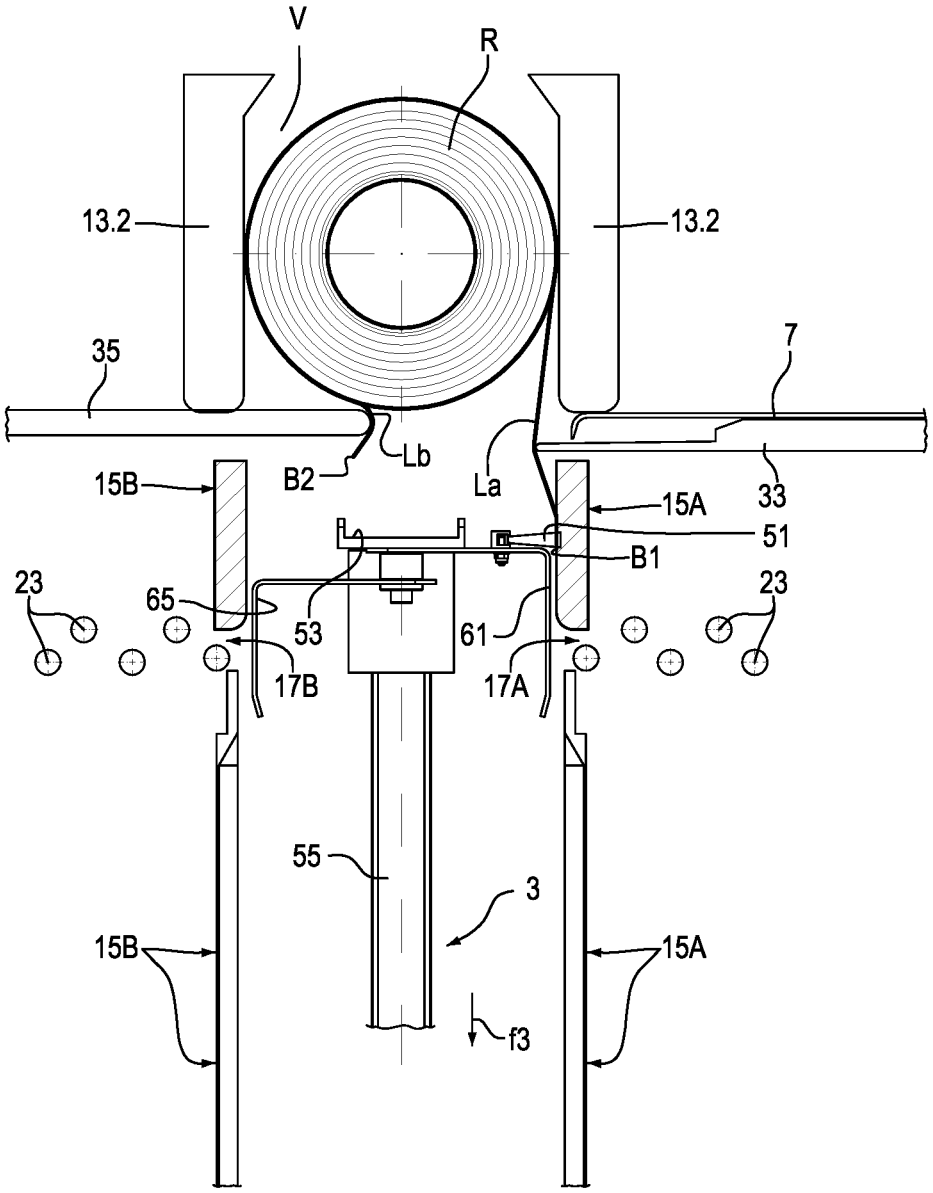
Figure 2E:
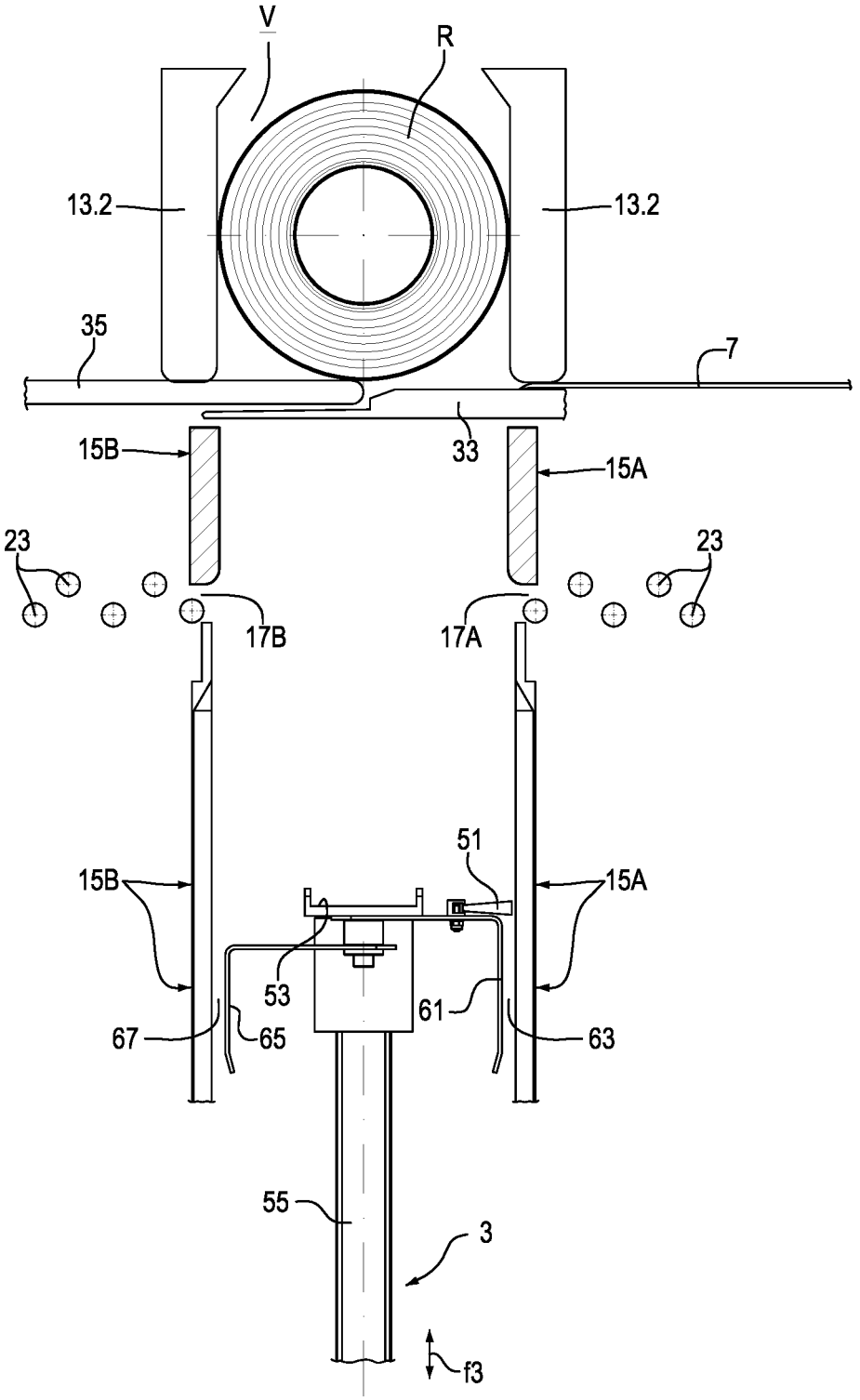

In FIG. 2C the roll R is in the upper position Qs and in FIGS. 2D, 2E the first folding member 33 and the second folding member 35 are folding and overlapping the edges B1 and B2 to complete wrapping of the roll R through 360°. In FIG. 2E the elevator 3 is lowered toward the lower position Qi to pick up a new roll R to be wrapped.

When passing from the step of FIG. 2A to the step of FIG. 2C, the edges B1, B2 of the wrapping sheet F are detached from the belts 22, as the wrapping sheet F wraps the roll R. In this step there is a greater risk of formation of creases by the flaps La and Lb of the wrapping sheet F, which can give rise to defects in the finished package.

To reduce these risks, in the embodiment illustrated two types of members adapted to reduce the formation of creases in the wrapping sheet are provided. These double members will be described with specific reference to FIGS. 2A-2E, which also illustrate their operating mode.

A first member to reduce the formation of creases in the wrapping sheet F comprises a brush 51, which is integral with the elevator 3 and moves therewith in the movement according to the arrow f3. More specifically, the brush 51 is integral with a seat 53 for housing the rolls R to be wrapped, which is part of the elevator 3. The seat 53 and the brush 51 are integral with a rod 55 movable according to the arrow f3.

The brush 51 extends approximately horizontally, hence orthogonal to the plane of FIGS. 2A, 2B, 2C, 2D, 2E and preferably has a length equal to or greater than the axial dimension of the rolls R. As the rolls R can be of variable dimensions, according to the production batch, the brush 51 can have a length equal to the maximum axial dimension of the rolls that can be handled with the packaging machine 1.

The brush 51 protrudes toward the lateral wall 15A. The dimension of the brush 51 can be such that the bristles thereof press lightly against the lateral wall 15A. As the position of the lateral wall 15A can be adjusted as a function of the dimensions of the diameters of the rolls R to be wrapped, the position of the brush 51 can also be adjustable, so as to co-act at all times with the inner surface, i.e. the surface facing the elevator 3, of the lateral wall 15A.

As can be clearly understood from FIGS. 2C and 2D, the brush 51 performs its function above all during the lowering step of the elevator 3, after the roll partially wrapped by the wrapping sheet F has been inserted into the corresponding compartment V of the conveyor device 13. While the elevator 3 is being lowered, the brush 51 is in rubbing contact with the flap La of the wrapping sheet F. As a result of the slight interference between the brush 51 and the lateral wall 15A, and as a result of the flexibility of the bristles of the brush 51, the flap La of the wrapping sheet is flattened and any creases that may have formed during lifting of the elevator 3 are flattened.

It must be understood that the brush 51 can consist of any material compatible with the action that it must perform on the wrapping sheet F and with the physical features (in particular rub resistance) of the wrapping sheet F. For example, the brush 51 can have actual bristles, but alternatively can consist of a plurality of flexible elements that protrude towards the lateral wall 15A and can bend as a result of light pressure between the brush 51 and the internal surface of the wall 15A.

Therefore, with this brush 51 any creases that may have formed as a result of the lifting speed of the roll R inside the wrapping sheet F are eliminated or substantially reduced without damaging or scoring the sheet. It must be understood that while in the embodiment described by way of example a brush 51 is provided, other embodiments can use a different contact and rubbing member adapted to co-act with the wrapping sheet F and with the lateral wall 15A.

In the example illustrated in the accompanying figures, a contact and rubbing member 51 is only provided on one side of the elevator 3 and more precisely on the side facing the sliding plane 7. This choice is due to the fact that on this side there are more potential problems deriving from the possible presence of creases in the flap La. In fact, as will be clearly understood from FIGS. 2A-2E, creases in the open flap La can wedge between the stationary plate forming the sliding plane 7 and the first folding member. If this happens it causes a slackening of the wrapping sheet during wrapping of the roll R and consequently a defective package is created.

However, it would also be possible to arrange a brush 51, or other contact and rubbing member, on the opposite side of the elevator 3, to co-act with the second lateral wall 15B and eliminate or reduce the creases in the flap Lb.

In substance, one or other (or both) the flaps La, Lb of the wrapping sheet F are stretched or smoothed by the brush 51 or other contact and rubbing member, in particular during the lowering movement of the elevator 3.

Further members for reducing or eliminating the creases in the wrapping sheet F can be provided in alternative or in addition to the contact and rubbing member 51.

In the embodiment illustrated in the accompanying drawings, the elevator 3 comprises a first plate 61 integral with the elevator 3 and hence movable therewith according to the arrow f3 in the lifting and lowering movement. The first plate 61 is advantageously adjacent and approximately parallel to the lateral wall 15A and spaced therefrom to form a first gap 63. This gap can have a transverse dimension (in a direction orthogonal to the first plate 61 and to the lateral wall 15A, for example comprised between about 0.5 mm and about 20 mm, preferably between about 0.5 mm and about 10 mm, more preferably between about 1.00 mm and about 7 mm.

In the illustrated embodiment, the first plate 61 also acts as support for the brush 51, but although preferable, this is not binding. In fact, in this way it is sufficient to adjust the position of a single member (plate 61) to adapt the elevator to variable dimensions of diameters of the roll R.

In the illustrated embodiment, a second plate 65 is also provided, located adjacent and parallel to the second lateral wall 15B. The second plate 65 is integral with the elevator 3 and hence moves together with the first plate 61. The second plate 65 defines together with the second lateral wall 15B, a second gap 67, which advantageously can have the same transverse dimension as the gap 63.

Both the plates 61, 65 can have, in a direction orthogonal to the plane of FIGS. 2A-2E, a dimension equal to the maximum axial dimension of the roll R.

The function of the two plates 61 and 65 is clarified by FIGS. 2B and 2C. When the elevator 3 is lifted and causes the edges B1, B2 to detach from the feed members 22 and from the support and guide bars 23, the flaps La and Lb are guided in the gaps 63 and 67. The transverse dimension (i.e., the dimension orthogonal to the plates 61, 65) of these gaps is such as to substantially reduce the tendency of the flaps La, Lb to flap about as a result of the aerodynamic effect during the rapid upward movement. This helps reducing the formation of creases in the flaps La, Lb.

Although in the illustrated embodiment two plates 61, 65 are provided, a part of the advantages described above can also be obtained with only one of the two plates 61, 65.

Moreover, although in the embodiment illustrated in the drawings several means are provided in combination to reduce the formation of creases, and in particular the brush 51 and the two plates 61, 65, at least partial reduction of the creases can be obtained with only one or only two of the elements 51, 61, 65.

The description above refers to some possible embodiments. It will be apparent to those skilled in the art that many modifications, changes and omissions are possible without departing from the spirit and scope of the appended claims.

The invention claimed is:

1. A machine for packaging rolls, comprising wrapping sheet feed members;

an elevator, adapted to move a roll to be wrapped with respect to the wrapping sheet, so as to wrap the wrapping sheet around the roll as a result of movement between the wrapping sheet and the roll;

a first lateral wall and a second lateral wall approximately parallel to the first lateral wall; wherein the elevator is vertically movable between the first lateral wall and the second lateral wall; and members adapted to reduce formation of creases, said members being integrally connected with the elevator and move vertically with the elevator, in the wrapping sheet during movement of the roll with respect to the wrapping sheet.

2. The machine of claim 1, wherein the members adapted to reduce formation of creases co-act with at least one of the first lateral wall and the second lateral wall.

3. The machine of claim 1, wherein the members adapted to reduce formation of creases comprise, on at least one side of the elevator, a crease reducer member oriented from the elevator toward one of said first lateral wall and said second lateral wall, and arranged so that when the elevator lifts the roll toward the wrapping sheet, said wrapping sheet is interposed between the crease reducer member and said one of said first lateral wall and said second lateral wall, the crease reducer member generating a contact force on the wrapping sheet and against the one of said first lateral wall and said second lateral wall at least during a lowering step of the elevator.

4. The machine of claim 3, wherein said crease reducer member comprises a brush.

5. The machine of claim 1, further comprising a conveyor device having a plurality of housing compartments adapted to receive rolls and related wrapping sheets from the elevator; wherein the conveyor device is provided with a roll advancing movement from a position for receiving the rolls from the elevator, toward folding members adapted to fold the wrapping sheet on end surfaces of the roll, and a gluing or welding assembly for closing of the package.

6. The machine of claim 5, wherein said conveyor device has an approximately horizontal direction of advance.

7. The machine of claim 5, further comprising a stationary plate extending below the conveyor device, in the direction of advance of the rolls engaged by the conveyor device, the stationary plate having a leading edge approximately at one of said first lateral wall and said second lateral wall.

8. The machine of claim 7, wherein below the stationary plate there is arranged a first folding member movable parallel to the stationary plate and provided with a folding movement to be inserted under a roll transferred from the elevator to the conveyor device.

9. The machine of claim 8, wherein the first folding member is adapted to co-act with a second folding member, associated with the second lateral wall and movable with respect thereto toward the folding member, to wrap flaps to the wrapping sheet under the roll transferred from the elevator to the conveyor device.

10. The machine of claim 1, wherein each of said first lateral wall and said second lateral wall defines a respective approximately horizontal slit, and wherein the wrapping sheet feed members is adapted to arrange said wrapping sheet on an approximately horizontal plane passing through said horizontal slits defined in the first lateral wall and said second lateral wall.

11. A machine for packaging rolls, comprising wrapping sheet feed members;

an elevator, adapted to move a roll to be wrapped with respect to the wrapping sheet, so as to wrap the wrapping sheet around the roll as a result of movement between the wrapping sheet and the roll;

a first lateral wall and a second lateral wall approximately parallel to the first lateral wall; wherein the elevator is vertically movable between the first lateral wall and the second lateral wall; and members adapted to reduce formation of creases, integral with the elevator, in the wrapping sheet during movement of the roll with respect to the wrapping sheet; and wherein the members adapted to reduce formation of creases comprise a first plate integral with the elevator and approximately parallel to said first lateral wall and said second lateral wall; wherein the first plate extends downward away from a seat for housing the roll, integral with the elevator; wherein the first plate defines, with a respective one of the first lateral wall and the second lateral wall with which the first plate is parallel, a first gap configured to receive therein a first flap of the wrapping sheet during lifting movement of the elevator.

12. The machine of claim 11, wherein the first gap has a transverse dimension, in a direction orthogonal to the first plate, comprising between about 0.5 mm and about 20 mm.

13. The machine of claim 11, wherein the members adapted to reduce formation of creases comprise a second plate, integral with the elevator and approximately parallel to the other of said first lateral wall and said second lateral wall; wherein the second plate extends downward away from said seat for housing the roll; wherein the second plate defines, with the respective one of the first lateral wall and the second lateral wall, a second gap configured to receive therein a second flap of the wrapping sheet during the lifting movement of the elevator.

14. The machine of claim 13, wherein the second gap has a transverse dimension, in a direction orthogonal to the second plate, comprising between about 0.5 mm and about 20 mm.

15. A machine for packaging rolls, comprising wrapping sheet feed members;

an elevator, adapted to move a roll to be wrapped with respect to the wrapping sheet, so as to wrap the wrapping sheet around the roll as a result of movement between the wrapping sheet and the roll;

a first lateral wall and a second lateral wall approximately parallel to the first lateral wall; wherein the elevator is vertically movable between the first lateral wall and the second lateral wall; and members adapted to reduce formation of creases, integral with the elevator, in the wrapping sheet during movement of the roll with respect to the wrapping sheet;

wherein the members adapted to reduce formation of creases comprise, on at least one side of the elevator, a crease reducer member oriented from the elevator toward one of said first lateral wall and said second lateral wall, and arranged so that when the elevator lifts the roll toward the wrapping sheet, said wrapping sheet is interposed between the crease reducer member and said one of said first lateral wall and said second lateral wall, the crease reducer member generating a contact force on the wrapping sheet and against the one of said first lateral wall and said second lateral wall at least during a lowering step of the elevator;

wherein the members adapted to reduce formation of creases further comprise a first plate integral with the elevator and approximately parallel to said first lateral wall and said second lateral wall; wherein the first plate extends downward away from a seat for housing the roll, integral with the elevator; wherein the first plate defines, with a respective one of the first lateral wall and the second lateral wall with which the first plate is parallel, a first gap configured to receive therein a first flap of the wrapping sheet during lifting movement of the elevator; and wherein the first plate extends below the crease reducer member.

16. A method for wrapping a roll in a wrapping sheet, comprising steps of:

arranging a roll on an elevator positioned between a first lateral wall and a second lateral wall and movable therebetween;

arranging a wrapping sheet on an approximately horizontal plane, which intersects a trajectory of movement of the elevator between the first lateral wall and the second lateral wall;

lifting the roll by the elevator against the wrapping sheet so as to partially wrap the roll with the wrapping sheet, generating two flaps of the wrapping sheet extending below the elevator;

wrapping the two flaps of the wrapping sheet around the roll;

wherein, during relative movement between the elevator and the wrapping sheet, a flattening action is exerted on at least one of said two flaps of the wrapping sheet by a member to reduce creases which is integrally connected with the elevator and moves vertically with the elevator.

17. The method of claim 16, wherein the member to reduce creases co-acts with at least one of said first lateral wall and said second lateral wall.

18. The method of claim 16, wherein the member to reduce creases comprises a crease reducer member, integral with the elevator, and wherein during the relative movement between the elevator and the wrapping sheet, the crease reducer member flattens at least one of said two flaps of the wrapping sheet against one of said first lateral wall and said second lateral wall at least during a lowering step of the elevator.

19. A method for wrapping a roll in a wrapping sheet, comprising steps of:

arranging a roll on an elevator positioned between a first lateral wall and a second lateral wall and movable therebetween;

arranging a wrapping sheet on an approximately horizontal plane, which intersects a trajectory of movement of the elevator between the first lateral wall and the second lateral wall;

lifting the roll by the elevator against the wrapping sheet so as to partially wrap the roll with the wrapping sheet, generating two flaps of the wrapping sheet extending below the elevator;

wrapping the two flaps of the wrapping sheet around the roll;

wherein, during relative movement between the elevator and the wrapping sheet, a flattening action is exerted on at least one of said two flaps of the wrapping sheet by a member to reduce creases which is integral with the elevator;

wherein the member to reduce creases comprises a first plate integral with the elevator and forming a first gap between the first plate and one of said first lateral wall and said second lateral wall; and wherein during lifting of the elevator, at least one of said two flaps of the wrapping sheet is inserted into the first gap; said first plate being substantially parallel to the respective one of the first lateral wall and the second lateral wall with which the first gap is formed.

20. The method of claim 19, wherein during lifting of the elevator, at least the other of said two flaps of the wrapping sheet is inserted into a second gap formed between a second plate, integral with the elevator, and the other of said first lateral wall and said second lateral wall; said second plate being substantially parallel to the respective one of the first lateral wall and the second lateral wall with which said second gap is formed.

* * * * *